US005918314A

United States Patent [19]

Moses

[11] Patent Number: 5,918,314

[45] Date of Patent: Jul. 6, 1999

[54] WATERPROOF INSULATIVE GARMENT

[76] Inventor: Melodie A. Moses, 118 Cookman Ave., Ocean Grove, N.J. 07756

[21] Appl. No.: 09/122,374

[22] Filed: Jul. 27, 1998

[51] Int. Cl.[6] ..... A41D 3/00

[52] U.S. Cl. ..... 2/79; 2/82; 2/84; 2/164

[58] Field of Search ..... 2/272, 901, 69, 2/79, 82, 239, 159, 164, 161.6, 81, 84, 85, 80, 97, 270

[56] References Cited

U.S. PATENT DOCUMENTS

| | | | |
|---|---|---|---|
| 1,485,392 | 3/1924 | Halek | 2/272 |
| 1,494,653 | 5/1924 | Walters | 2/239 |
| 3,613,687 | 10/1971 | Kennedy | 128/288 |
| 4,023,223 | 5/1977 | Anderson et al. | 2/79 |
| 4,038,698 | 8/1977 | Smith | 2/79 |
| 4,308,622 | 1/1982 | Maddron | 2/79 |
| 4,386,438 | 6/1983 | Evin | 2/272 |
| 4,662,006 | 5/1987 | Ross, Jr. | 2/164 |
| 5,005,216 | 4/1991 | Blackburn et al. | 2/901 |
| 5,088,115 | 2/1992 | Napolitano | 2/901 |
| 5,159,716 | 11/1992 | Takata | 2/2.1 R |
| 5,378,529 | 1/1995 | Bourdeau | 428/224 |
| 5,539,928 | 7/1996 | Aldridge | 2/93 |
| 5,724,680 | 3/1998 | Cesnick et al. | 2/239 |

*Primary Examiner*—Amy B. Vanatta
*Attorney, Agent, or Firm*—David L. Volk

[57] ABSTRACT

A body suit liner is removably attachable to an outer body suit. Glove liners are removably attachable to outer gloves. Foot cover liners are removably attachable to outer foot covers. A hood liner is removably attachable to an outer hood. The outer gloves are removably attachable to distal ends of outer body suit sleeves. The outer glove can be attached to the outer body suit sleeve whether or not the glove liner has been attached to the outer glove. The outer foot covers are removably attachable to distal ends of outer body suit legs. The outer foot cover can be attached to the outer body suit leg whether or not the foot cover liner has been attached to the outer foot cover. The outer hood is removably attachable to the outer body suit. The outer hood can be attached to the outer body suit whether or not the hood liner has been attached to the outer hood. The body suit liner, glove liner, foot cover liner and hood liner are constructed of material which is insulative and absorbent. The outer body suit, outer glove, outer foot cover, and outer hood are constructed of lightweight, waterproof material.

5 Claims, 1 Drawing Sheet

WATERPROOF INSULATIVE GARMENT

BACKGROUND OF THE INVENTION

1. Field of the Invention

The present invention relates to clothing, particularly to waterproof and insulative garments, and to body suits.

2. Description of the Related Art

When out of doors for any type of activity, it is often desirable to dress warmly, and to shield oneself from the harsher effects of the environment, such as wind, rain, sea spray, and cool air temperature.

After swimming, it is desirable to do all of the above, as well as to dry oneself for greater comfort and for less heat loss from the body through evaporation.

SUMMARY OF THE INVENTION

The waterproof, insulative garment of the present invention includes a body suit liner, an outer body suit, two glove liners, two outer gloves, two foot cover liners, two outer foot covers, a hood liner, and an outer hood.

The body suit liner is removably attachable to the outer body suit. The glove liners are removably attachable to the outer gloves. The foot cover liners are removably attachable to the outer foot covers. The hood liner is removably attachable to the outer hood.

The outer gloves are removably attachable to distal ends of the outer body suit sleeves. The outer glove can be attached to the outer body suit sleeve whether or not the glove liner has been attached to the outer glove.

The outer foot covers are removably attachable to distal ends of the outer body suit legs. The outer foot cover can be attached to the outer body suit leg whether or not the foot cover liner has been attached to the outer foot cover.

The outer hood is removably attachable to the outer body suit. The outer hood can be attached to the outer body suit whether or not the hood liner has been attached to the outer hood.

The body suit liner, glove liner, foot cover liner and hood liner are constructed of material which is insulative and absorbent. The outer body suit, outer glove, outer foot cover, and outer hood are constructed of lightweight, waterproof material.

The garment of the present invention may be worn with or without the liner portions, may be used by swimmers to remove moisture from the body, and provides warmth and protection from the elements. The various closures between the portions of the garment enhance warmth and protection from the elements.

Still further features and advantages will become apparent from the ensuing description and drawings.

DETAILED DESCRIPTION

Figure 1:
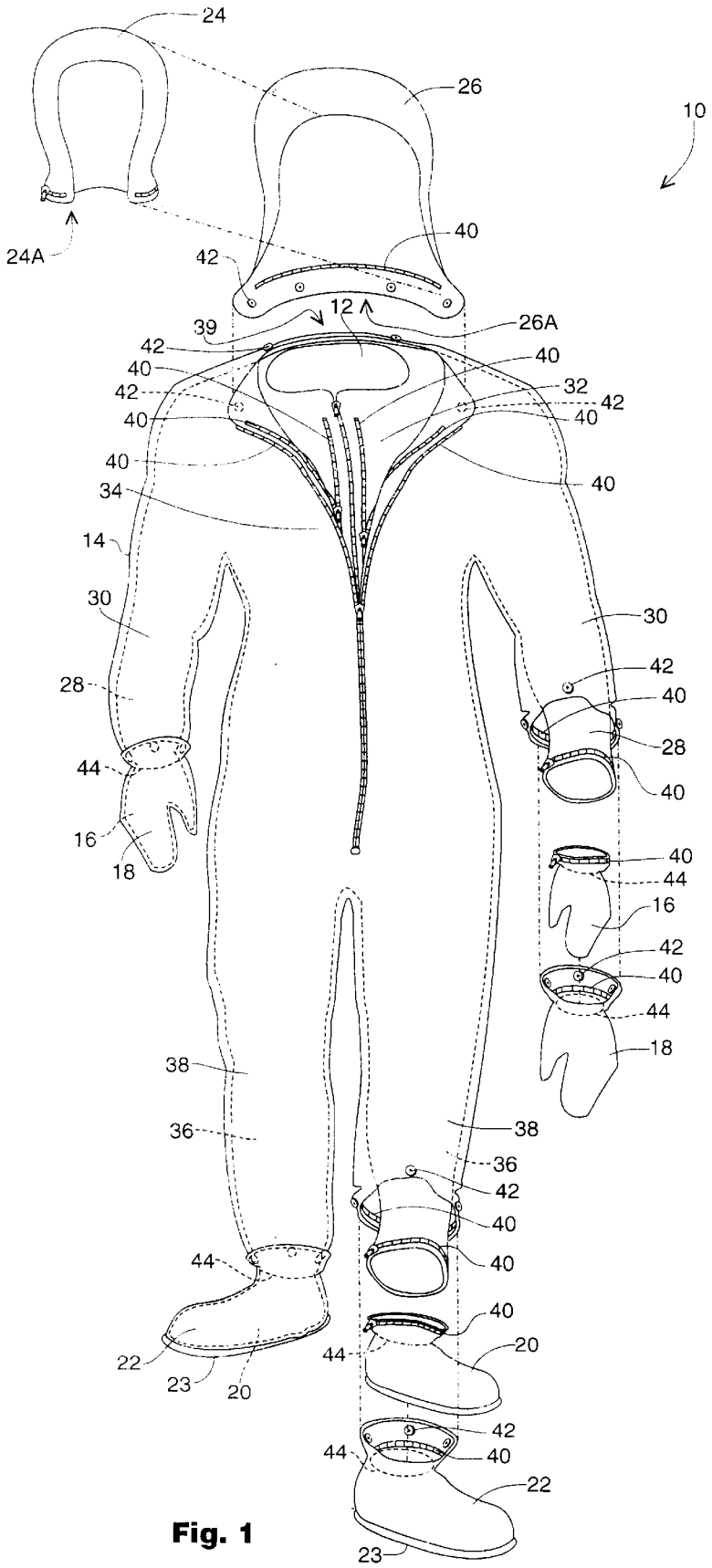
FIG. 1 is an exploded perspective view of a garment of the present invention.

FIG. 1 is an exploded perspective view of a garment 10, comprising a body suit liner 12, an outer body suit 14, two glove liners 16, two outer gloves 18, two foot cover liners 20, two outer foot covers 22, a hood liner 24, and an outer hood 26. The outer foot covers 22 have treads 23 on the underside thereof.

The body suit liner 12 is removably attachable to the outer body suit 14 at distal ends of body suit liner sleeves 28 and outer body suit sleeves 30, along a body suit liner torso section 32 and an outer body suit torso section 34, and at distal ends of body suit liner legs 36 and outer body suit legs 38.

The glove liners 16 are removably attachable to the outer gloves 18 near the open ends thereof. The foot cover liners 20 are removably attachable to the outer foot covers 22 near the open ends thereof. The hood liner 24 is removably attachable to the outer hood 26 near the neck portions 24A, 26A thereof.

As shown in these figures, all of these attachments are accomplished with zippers 40, although other known attachment structure is possible.

The outer gloves 18 are removably attachable to distal ends of the outer body suit sleeves 30 near the open ends of the outer gloves 18. In the figure, this attachment is accomplished with snaps 42, although other known attachment structure is possible. The snaps 42 are positioned closer to the open end of the outer glove 18 than is the zipper 40 which is attached to the outer glove 18. This permits the outer glove 18 to be attached to the outer body suit sleeve 30 whether or not the glove liner 16 has been attached to the outer glove 18.

The outer foot covers 22 are removably attachable to distal ends of the outer body suit legs 38 near the open ends of the outer foot covers 22. In the figure, this attachment is accomplished with snaps 42, although other known attachment structure is possible. The snaps 42 are positioned closer to the open end of the outer foot cover 22 than is the zipper 40 which is attached to the outer foot cover 22. This permits the outer foot cover 22 to be attached to the outer body suit leg 38 whether or not the foot cover liner 20 has been attached to the outer foot cover 22.

The outer hood 26 is removably attachable to a neck portion 39 of the outer body suit 14 near a neck portion 26A of the outer hood 26. In the figure, this attachment is accomplished with snaps 42, although other known attachment structure is possible. The snaps 42 are positioned closer to the neck portion 26A of the outer hood 26 than is the zipper 40 which is attached to the outer hood 26. This permits the outer hood 26 to be attached to the outer body suit 14 whether or not the hood liner 24 has been attached to the outer hood 26.

The glove liners 16, the outer gloves 18, the foot cover liners 20, and the outer foot covers 22 each have elastic liner 44 near the open ends thereof, for snug fit to the wearer (not shown).

The body suit liner 12, glove liner 16, foot cover liner 20, and hood liner 24 are constructed of any conventional material which is insulative. If the invention is constructed for use after swimming, the liner material should be absorbent to absorb moisture from the body. It would also be within the scope of the invention to construct the liner of a first layer and a second layer, the first layer being closest to the skin and being woven of hydrophobic fibers capable of carrying moisture away from the skin toward the second layer by capillary action, the second layer being absorbent. This type of material would provide a more comfortable feeling of dryness for the wearer. Similar structures are known for disposable diapers.

The outer body suit 14, outer glove 18, outer foot cover 22, and outer hood 26 are constructed of any known, lightweight, waterproof material.

Thus, the garment 10 of the present invention may be worn with or without the liner portions, may be used by swimmers to remove moisture from the body, and provides warmth and protection from the elements. The various closures between the portions of the garment 10 provide optimum protection from the elements.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A garment comprising:

a. an outer body suit;

b. a body suit liner removably attachable to the outer body suit;

c. a pair of outer gloves;

d. a pair of glove liners removably attachable to the outer gloves;

e. a pair of outer foot covers;

f. a pair of foot cover liners removably attachable to the outer foot covers;

g. an outer hood;

h. a hood liner removably attachable to the outer hood;

i. the outer gloves removably attachable to distal ends of sleeves of the outer body suit, whether or not the glove liners are attached to the outer gloves;

j. the outer foot covers removably attachable to distal ends of legs of the outer body suit, whether or not the foot cover liners are attached to the outer foot covers; and k. the outer hood removably attachable to the outer body suit, whether or not the hood liner is attached to the outer hood.

2. The garment of claim 1, wherein the body suit liner, the glove liners, the foot cover liners and the hood liner are constructed of material which is insulative and absorbent.

3. The garment of claim 2, wherein the outer body suit, the outer gloves, the outer foot covers, and the outer hood are constructed of waterproof material.

4. The garment of claim 1, wherein the outer body suit, the outer gloves, the outer foot covers, and the outer hood are constructed of waterproof material.

5. A garment comprising:

a. an outer body suit;

b. a body suit liner removably attachable to the outer body suit;

c. a pair of outer gloves;

d. a pair of glove liners removably attachable to the outer gloves;

e. a pair of outer foot covers;

f. a pair of foot cover liners removably attachable to the outer foot covers;

g. the outer gloves removably attachable to distal ends of sleeves of the outer body suit, whether or not the glove liners are attached to the outer gloves; and h. the outer foot covers removably attachable to distal ends of legs of the outer body suit, whether or not the foot cover liners are attached to the outer foot covers.

* * * * *